US005097293A

United States Patent [19]

Seto et al.

[11] Patent Number: 5,097,293

[45] Date of Patent: Mar. 17, 1992

[54] METHOD AND DEVICE FOR CONTROLLING TONER DENSITY OF AN ELECTROSTATIC PRINTING APPARATUS EMPLOYING TONER

[75] Inventors: Fumiaki Seto, Yokohama; Yutaka Takenaka, Machida, both of Japan

[73] Assignee: Fujitsu Limited, Kanagawa, Japan

[21] Appl. No.: 385,512

[22] Filed: Jul. 27, 1989

[30] Foreign Application Priority Data

Aug. 3, 1988 [JP] Japan ..... 63-193983
Aug. 22, 1988 [JP] Japan ..... 63-207932

[51] Int. Cl.[5] ..... G03G 21/00
[52] U.S. Cl. ..... 355/208; 355/246
[58] Field of Search ..... 355/203, 208, 209, 215, 355/246, 204, 205, 206, 68

[56] References Cited

U.S. PATENT DOCUMENTS

| | | | |
|---|---|---|---|
| 4,082,445 | 4/1978 | Steiner | 355/246 |
| 4,178,095 | 12/1979 | Champion et al. | 355/246 X |
| 4,272,182 | 6/1981 | Abe et al. | 355/246 |
| 4,279,498 | 7/1981 | Eda et al. | 355/246 |
| 4,312,589 | 1/1982 | Brannen et al. | 355/246 X |
| 4,313,671 | 2/1982 | Kuru | 355/246 X |
| 4,372,672 | 2/1983 | Pries | 355/246 X |
| 4,502,778 | 3/1985 | Dodge et al. | 355/246 X |
| 4,508,446 | 4/1985 | Imai | 355/208 |
| 4,670,647 | 6/1987 | Hubble, III et al. | 355/203 X |
| 4,801,980 | 1/1989 | Arai et al. | 355/246 X |
| 4,829,386 | 5/1989 | Champion et al. | 355/246 X |
| 4,833,506 | 5/1989 | Kuru et al. | 355/246 X |
| 4,951,088 | 8/1990 | Bonvallet et al. | 355/208 X |

FOREIGN PATENT DOCUMENTS

| | | | |
|---|---|---|---|
| 054637 | 6/1982 | European Pat. Off. . | |
| 2915052 | 10/1979 | Fed. Rep. of Germany . | |
| 2952672 | 7/1980 | Fed. Rep. of Germany . | |
| 58-35552 | 3/1983 | Japan . | |
| 0086563 | 5/1983 | Japan | 355/246 |
| 0030565 | 2/1984 | Japan | 355/246 |
| 0048776 | 3/1984 | Japan | 355/208 |
| 0053869 | 3/1984 | Japan | 355/208 |
| 0131574 | 7/1985 | Japan | 355/246 |
| 0110476 | 5/1988 | Japan | 355/246 |
| 0110477 | 5/1988 | Japan | 355/246 |
| 0121067 | 5/1988 | Japan | 355/246 |
| 00223760 | 9/1988 | Japan | 355/204 |
| 0082068 | 3/1989 | Japan | 355/246 |
| 212750A | 4/1984 | United Kingdom . | |

OTHER PUBLICATIONS

Patent Abstracts of Japan, vol. 12, No. 370, (P-767)[3217], Oct. 5, 1988.
Patent Abstracts of Japan, vol. 8, No. 105, (P-274)[1542], May 17, 1984.

*Primary Examiner*—A. T. Grimley
*Assistant Examiner*—Matthew S. Smith
*Attorney, Agent, or Firm*—Armstrong, Nikaido, Marmelstein, Kubovcik & Murray

[57] ABSTRACT

In an electrostatic recording apparatus according to the present invention, while a photosensitive drum and a drum cleaner are enabled, but an electrostatic latent image is not formed on the drum and a developing unit is not operated yet, a light emission level of an LED, which is controlled so as to keep a received light level of a photo-diode which receives the LED's light reflected from the drum, is measured as a first light emission level. If the first light emission level exceeds a predetermined level it is determined that the detector composed of the LED and the photodiode is contaminated and requires cleaning. Next, the developer is enabled while the latent image is not formed yet. The light emission level to keep the same received light level is measured as a second light emission level. If a difference between the first and second light emission levels exceeds a predetermined limit level, it is determined that the photosensitive drum and/or carrier in developer is deteriorated. Thus, an interval for cleaning the detector is extended, and the deterioration of the drum and/or the carrier is distinguished from the contamination of the detector.

18 Claims, 7 Drawing Sheets

FIG.6(A)
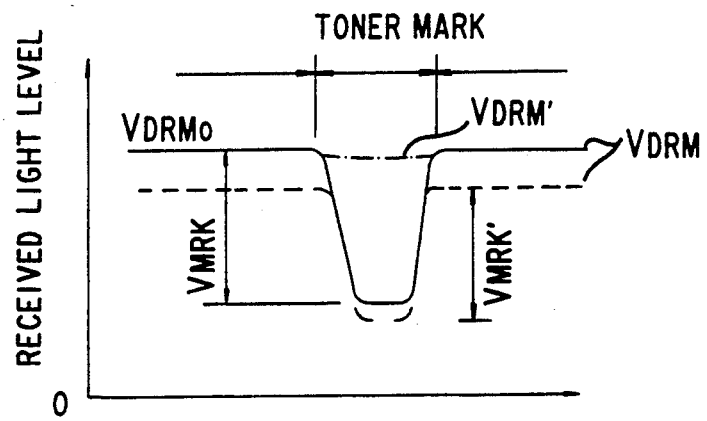
FIG.6(B)
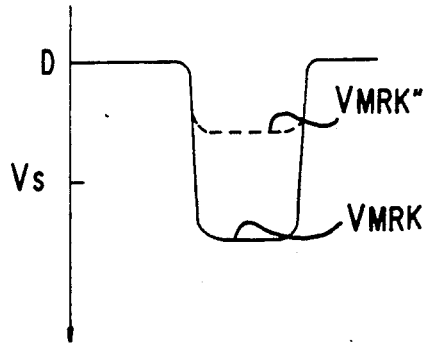
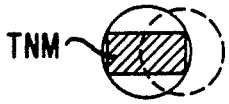
FIG.7

METHOD AND DEVICE FOR CONTROLLING TONER DENSITY OF AN ELECTROSTATIC PRINTING APPARATUS EMPLOYING TONER

BACKGROUND OF THE INVENTION

1. Field of the Invention

This invention relates to a recording apparatus employing a toner image produced on an electrostatic latent image forming medium, such as electrophotographic printing apparatus, and particularly relates to a method of detecting the end of useful life of the image forming media, as well as the developer carrier.

2. Description of the Related Art

In an apparatus utilizing toner development, such as an electro-photographic apparatus, the toner is consumed for development. Therefore, it is required to supply toner into a developing unit so as to keep the toner density constant.

In order to control this toner density, there has been a method employing a particular toner mark formed on a latent image forming medium, i.e. on a photosensitive drum, and an optical detector which is composed of a light emitting device to project a light spot on the surface of the photosensitive drum and a light receiving device to receive light reflected from the projected spot on the photosensitive drum. The optical detector detects the toner mark so as to measure its toner density. According to this measured toner density, a supply of the toner to developer in a developing unit is controlled so that a uniform toner darkness is achieved in the printed image.

The optical detector is employed also for detecting whether a developer (carrier) in the developing unit is worn out having reached the end of its useful life, as well as for detecting the end of the photosensitive drum's useful life caused by contamination, such as the generation of filming, etc. When the carrier is fatigued, the toner clings to the carrier causing an increase in electrical resistivity of the carrier. Accordingly, an undesirable toner stays on the photosensitive drum where no toner should remain. This undesirable toner deteriorates the contrast of printed images. When the photosensitive drum is fatigued worn out, the photosensitive drum loses its electric charging capability. Undesirable toner remains on the area to which no light has been projected. As a result the contrast is also deteriorated. Thus decreased reflection from the drum surface causes a decrease in the received light level as well as in an amplitude of the toner mark in the received light.

The optical detector must be located close to the photosensitive drum in order to detect the toner mark and the contamination of the drum itself. As such the light emitting window as well as the light-receiving window of the detector is likely to be contaminated with the toner floating out from the photosensitive drum. When the window of the optical detector is contaminated, the light receiving level of the detector decreases thereby resulting in greater error in detecting the toner density, etc..

When the optical detector is contaminated, the detector must be cleaned up. Conventionally, air has been blown onto the detector in order to remove the toner contamination on the detector. However, the air blowing method has a problem because a narrow gap between the photosensitive drum and the detector causes difficulty in blowing the air directly onto the light receiving surface. Furthermore, there is also a problem in that strong blowing disturbs the toner image on the photosensitive drum.

When the level of the received light reflected from the photosensitive drum, except from the toner mark, deteriorates to a certain level, it is determined that the detector is contaminated, and then cleaning must be performed. However, in this method has a problem in that not only is a degree of the contamination not correctly grasped, but also a fast contamination caused from many print operations shortens the interval of the cleaning operations, resulting in an increase of maintenance.

Furthermore, even though the deterioration of the drum or the carrier takes place much slower than the detector's contamination once the drum or the carrier is deteriorated, it is impossible to determine whether the decline of the received light level is caused by the detector's contamination, by the deterioration of the photosensitive drum or by the deterioration of the toner carrier. Accordingly, it is impossible to properly compensate the variation of the toner density.

Furthermore, there has been proposed a method to detect the toner density by a differential output of a pair of detectors as disclosed in Japanese Patent Publication, No. Sho 63-14348, etc.. In this method of providing a pair of the detectors, it is a problem that a detector is required, which further requires an additional space and cost for installation. It is also a problem that an alignment of the optical detector to the toner mark is difficult. It is impossible to determine whether the deterioration of the received light level is caused by the detector's contamination, from by the deterioration of the photosensitive drum or by the deterioration of the toner carrier.

SUMMARY OF THE INVENTION

It is a general object of the invention, therefore to provide a method of detecting deteriorations of the electrostatic image forming medium and carrier in a developer, independently from a contamination of a optical detector employed therein.

It is another object of the invention to provide a method of detecting the contamination of the optical detector which detects toner density of a toner mark provided on an electrostatic image forming medium.

It is a further object of the invention to provide a method for extending an interval of maintenance of the optical detector.

It is a further object of the invention to provide a method for easily aligning an optical detector to a toner mark on an electrostatic image forming media.

According to the present invention, when a photosensitive drum rotation and its pre-charger are enabled but the magnetic roll, its bias charger and the toner mixer in the developing unit are not enabled yet, a received light level of an optical detector is fed back to control a light emission of the optical detector so that the received light level becomes a predetermined reference level, and then the light emission level is measured as a first light emission level. If the first light emission level exceeds a predetermined level, it is determined that the optical detector is so contaminated that cleaning is required. Next, while the magnetic roll, its bias charger and the toner mixer are enabled, a light emission level, which keeps the received light level equal to the predetermined reference level, is measured as a second light emission level. A difference of the first and second light emission levels indicates a degree of deterioration of the photosensitive drum and/or the carrier in the developer. If this difference exceeds a predetermined limit level, it is judged that the photosensitive drum and/or the carrier must be changed. If the difference is smaller than or equal to the limit level, the light emission level is kept at the second light emission level, and a printing procedure is started.

According to the above-described procedure, a contamination of the optical detector and the deterioration of the photosensitive drum and/or the developer carrier can be distinguished.

An increase in the first light emission level correctly indicates a degree of the contamination of the optical detector, and accordingly can determine an appropriate timing for cleaning the optical detector. Therefore, an interval of detector cleanings can be more properly extended compared to that of the conventional method where the decreased received light level includes the deterioration of the photosensitive drum and/or the carrier deterioration.

According to a method or device of the present invention, the location of the optical detector is easily adjusted while a feedback loop for automatically setting the received light level at a constant level is disabled.

The above-mentioned features and advantages of the present invention, together with other objects and advantages, which will become apparent, will be more fully described hereinafter, with reference being made to the accompanying drawings which form a part hereof, wherein like numerals refer to like parts throughout.

BRIEF DESCRIPTION OF THE DRAWINGS

FIGS. 6A–6B are waveforms of a received light signal indicating reflection from a surface of a photosensitive drum and a toner mark according to the present invention.

FIG. 7 illustrates an alignment of the optical detector to the toner mark.

DESCRIPTION OF THE PREFERRED EMBODIMENTS

Figure 1:
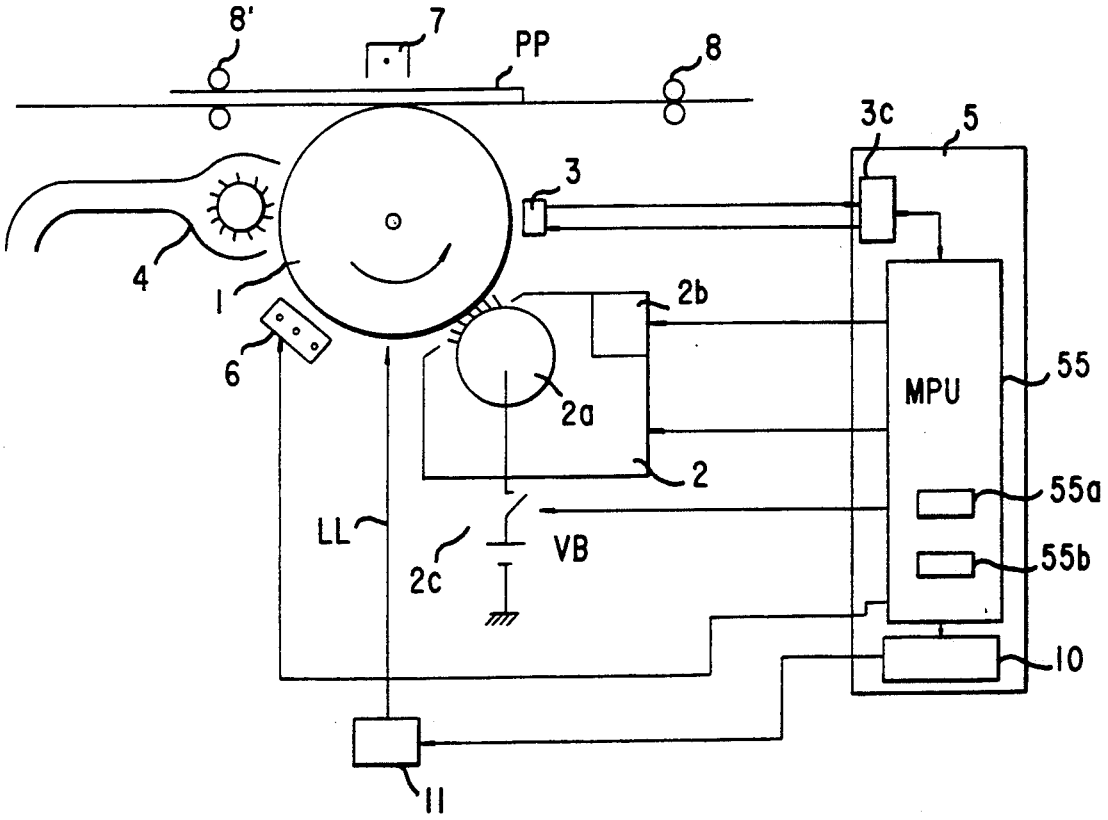
FIG. 1 schematically illustrates a constitution of electrophotographic printing apparatus where the present invention is embodied.

A laser printer is schematically illustrated in FIG. 1 as an example of preferred embodiment of the present invention. At first, a general operation of the laser printer is hereinafter described. A photosensitive drum 1 rotates along the arrow in the figure. A cleaner 4 comprising a brush wipes off toner remaining on the surface of the rotating photosensitive drum 1. A pre-charger 6 electrically charges the photosensitive drum with typically ±600 volt. A light modulator 11 comprising a laser oscillator sequentially outputs a laser light LL according to information to be printed on a paper sheet PP. The laser light LL is scanned along the axial direction of the photosensitive drum 1 and focused on the surface of the photosensitive drum by means which are not shown in the figure. A light spot projected on the photosensitive drum 1 locally discharges the electric charge of the spot area. Thus, a latent image is electrostatically formed on the photosensitive drum 1. A developing unit 2 comprises a magnetic roll 2*a;* a toner supplier 2*b;* and a toner mixer (not shown in the figure) and contains two-component developer therein, which is composed of carrier and toner. Magnets installed in the magnetic roll 2*a* coaxially rotates therein. The magnetic roll 2*a* together with the toner thereon is electrically charged with a bias voltage VB, typically ±100 volt, via a bias switch 2*c*. The carrier, which is powder of magnetic material mixed with the toner, is attracted by the magnets onto the surface of the magnetic roll 2*a*, and is conveyed, i.e. supplied, towards the photosensitive drum 1 by the rotation of the magnets. The toner, thus charged with ±600 volt, and facing the photosensitive drum 1 is attracted by a spot area, which has been electrically discharged by the laser light, and transferred onto the spot of the photosensitive drum 1. Thus, a toner image is developed on the photosensitive drum 1. An optical detector 3 comprises a light emitting device 3*a* (FIG. 2), such as a light emitting diode (referred to hereinafter as an LED), which projects a light spot onto the surface of the photosensitive drum 1, and a light receiver 3*b* (FIG. 2), such as a photo diode, which receives light reflected from the light spot on the photosensitive drum 1. More details about the optical detector will be described later. The toner image on the photosensitive drum 1 is conveyed towards a sheet of paper PP. Behind the sheet PP there is provided a transfer charger 7, which 25 charges the sheet PP with typically + −5 kV. Accordingly, the toner image face-contacting the sheet PP is electrostatically transferred from the photosensitive drum 1 onto the sheet PP. The sheet PP is fed in by rollers 8 and driven out by rollers 8'. While the sheet having the toner image thereon is pinched by the drive-out rollers 8', the toner is melt to be permanently fixed onto the sheet. A control circuit 5 comprises a micro processor (referred to hereinafter as MPU) 55, a detector controller 3*c* and a toner mark generating circuit 10. Details of the functions of MPU 55 will be described later.

Figure 3:
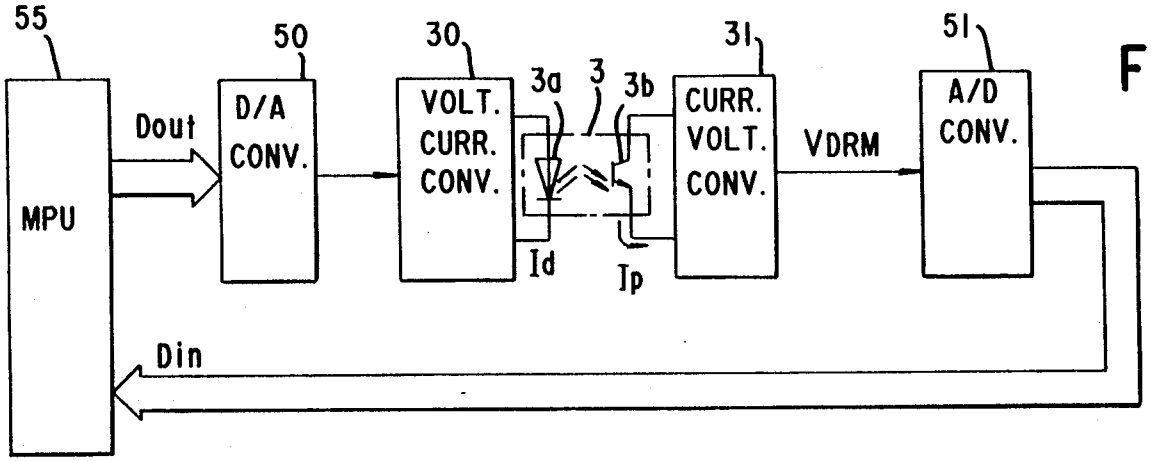
FIG. 3 is a block diagram of a detector control circuit employed in an embodiment of the present invention.

FIG. 3 shows a block diagram of a detector control circuit 3*c*. A D/A (digital/analog) converter 50, typically of 8 bits, i.e. having 254-step resolution, receives a digital level Dout to determine the light emission level of LED 3*a*, from MPU 55 and converts it into an analog voltage. A voltage-current converter 30 converts this analog voltage into a current Id to drive LED 3*a*. A photo diode 3*b* generates a photo current Ip depending on a light level reflected and received thereto. A current-voltage converter 31 converts the photo current Ip into an analog volta $V_{DRM}$. An A/D (analog/digital) converter 51, typically of 8 bits, converts this voltage into a digital receiving light level Din, which is then input to the micro processor MPU 55.

The MPU 55 executes, by a program, an ON/OFF control of the rotation of the photosensitive drum 1; an ON/OFF control of the rotations of the magnetic roll 2*a* and a toner mixer in the developing unit 2; an ON/-OFF control of the bias charger 2*c;* ON/OFF control of the pre-charger 6; a supply control of the toner from the toner supplier 2b; and a level control of light emission of the LED 3a.

Figure 4A:
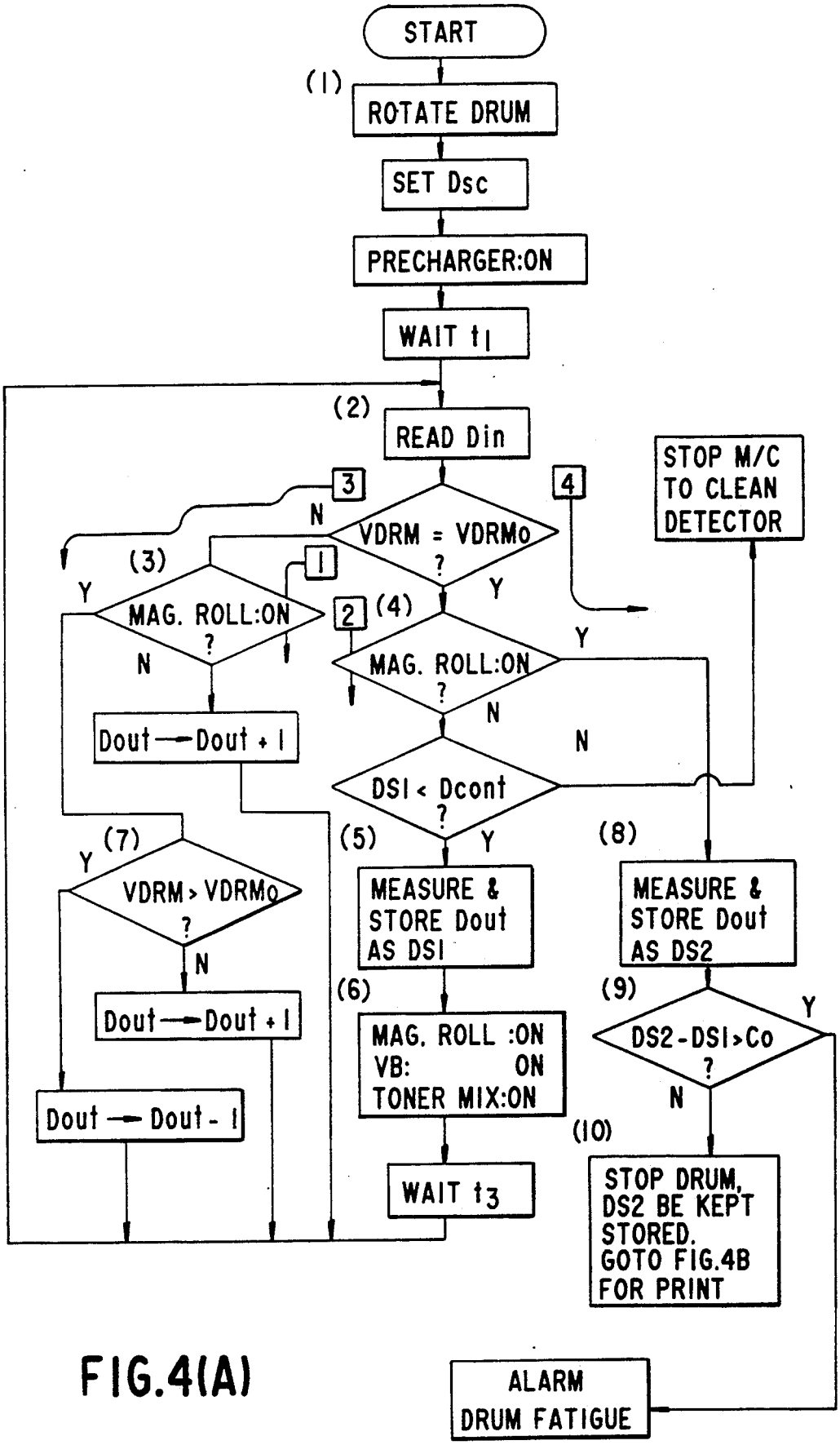
FIG. 4 (A) is a flow chart showing steps of an embodiment of the present invention.
FIG. 4(B) is a flow chart of a step for toner density control.

Operation of the laser printer according to the present invention is hereinafter described in reference to flow chart of FIG. 4(A) and a timing chart of FIG. 5. Numbers in circles in FIGS. 4(A)–4(B) correspond to the number given to each step in the below description. Numbers in squares in FIGS. 4(A)–4(B) indicate each sequence of the flow.

(1) When the laser printer is to start up, the MPU 55 starts rotating the photosensitive drum 1, while disabling the pre-charger 6; the laser light LL; the magnetic roll 2a; the supply of the bias voltage VB; the sheet feed; and the transfer charger 7. Then, MPU 55 sets an appropriate amount Dsc in Dout to determine the light emission level of the LED; for example, 10 mA input to the LED. Next, the pre-charger 6 is enabled. While the photosensitive drum 1 is thus rotating for a period $t_1$, for example, 30 seconds, which is equivalent to 11 rotations of the drum, all the toner existing between the magnetic roll 2a and the photosensitive drum 1 is electrostatically attracted and transferred onto the photosensitive drum 1 because no more toner is supplied thereto now as well as no bias voltage VB is applied thereto. The toner on the photosensitive drum 1 is wiped away by the cleaner 4. Thus, the surface of the photosensitive drum becomes clean without any toner thereon.

(2) MPU 55 reads received light level Din of the photo diode 3b, from the A/D converter 51, as a drum level $V_{DRM}$. MPU 55 compares the drum level $V_{DRM}$ with a predetermined reference level $V_{DRMO}$, which is for example, 10V.

(3) When it is determined that $V_{DRM} \neq V_{DRMO}$, it means the received light level is low, because the light emission level has been set at a relatively low Dsc, which corresponds to, for example, 10 mA to LED 2a.

Next, MPU 55 checks whether the magnetic roll 2a is driven. If, the magnetic roll 2a is not driven, MPU 55 instructs an increase in the light emission level Dout, which has been Dsc, up to Dout+1. After waiting a response period $t_5$ during which the result of Dout+1 appears in the output Din, the step goes back to (2), and repeats until $V_{DRM}$ becomes equal to $V_{DRMO}$ during a period $t_2$, for example, 2 seconds. This step is indicated additionally by route [1] in the flow chart.

(4) Thus, after thus increasing the light emission level, if it is determined that $V_{DRM}$ has reached the predetermined reference level $V_{DRMO}$, then MPU 55 checks whether the magnetic roll 2a is driven. If the magnetic roll 2a is not driven, the step goes to (5).

(5) The light emission level Dout is measured by MPU 55 and stored in register 55a as a first light emission level DS1, which, in other words, is a non-driven developer state level. The amount of DS1 corresponds to, for example, 11 mA in this case. The first light emission level DS1 indicates the degree of the detector contamination, and increases as the LED 3a and/or the photo diode 3b is contaminated with toner, etc.. The amount of DS1 is compared with a predetermined limit level Dcont, for example, corresponding to 20 mA in this example. If DS1 exceeds the limit level Dcont, MPU 55 issues an alarm so that the detector window is to be cleaned. Cleaning of the detector is generally carried out by manually wiping the window surfaces while the photosensitive drum 1 is detached from the printer chassis.

(6) When DS1 is below the limit Dcont in step (5), MPU 55 instructs to drive the magnetic roll 2a and the toner mixer, and to close the bias switch 2c so as to apply the bias voltage VB to the magnetic roll 2a. Then, waiting a period $t_3$ during which developer in the developing unit 2 is uniformly mixed up. These steps (5) and (6) are indicated additionally with route [2].

Then, the step goes back to (2).

(7) Because the developing unit 2 has been operating, some of the toner stays on the photosensitive drum 1, if the photosensitive drum 1 and/or the carrier in the developer is worn down. Therefore, $V_{DRM}$ decreases with the toner on the photosensitive drum 1, accordingly $V_{DRM} \neq V_{DRMO}$. Thus, the step goes along route [3] MPU 55 instructs an increase in the light emission level from Dout to Dout+1. If $V_{DRM} > V_{DRMO}$, MPU 55 instructs a decrease in the light emission level from Dout to Dout-1. Then, after waiting a period $t_5$ during which the result of increasing/decreasing the amount of Dout appears in the output Din, the step goes back to (2). This step repeats until $V_{DRM}$ becomes equal to $V_{DRMO}$.

Thus, if, it is determined judged that $V_{DRM} = V_{DRMO}$, then MPU 55 checks whether the magnetic roll 2a is driven. If the magnetic roll 2a has been enabled, the program goes to step (8).

(8) The amount of the light emission level Dout is measured and stored by MPU 55 in register 55b as a second light emission level DS2, which, in other word, is a driven-developer state level for the same received light level $V_{DRMO}$. The amount of DS2 corresponds, for example, 12 mA in this example. The step (8) is indicated additionally with route [4].

(9) MPU 55 checks next whether a difference, between the first and second light emission levels, in other words, between the non-driven developer state level DS1 and the driven-developer state level DS2, that is (DS2−DS1), is larger than a predetermined limit level Co corresponding to, for example, 3 mA. If (DS2−DS1)>Co, that is, if DS2 becomes larger than 13 mA in this example, it is determined that the photosensitive drum 1 and/or the carrier has reached the end of their useful lives. Accordingly, then MPU 55 outputs an alarm so that a printing operation is inhibited for an operator to exchange the necessary parts. The above-described automatic light emission level control and the automatic checks of the drum/developer fatigue according to step 2 through 9 may be periodically carried out either at the time of starting up the system, i.e. power supply is switched on, or according to a predetermined period, such as an operation time of the system since the power supply has been on, an operation time of the photosensitive drum rotation, or number of printed sheets, measured or counted by MPU 55.

(10) When it is determined that (DS2−DS1) is equal to or less than Co, it means that the photosensitive drum 1 and the carrier are not worn out of yet. Therefore, the printer is ready for the printing process. During the stand-by for the printing process, the drum may be generally stopped while the second light emission level DS2 is stored.

Figure 4B:
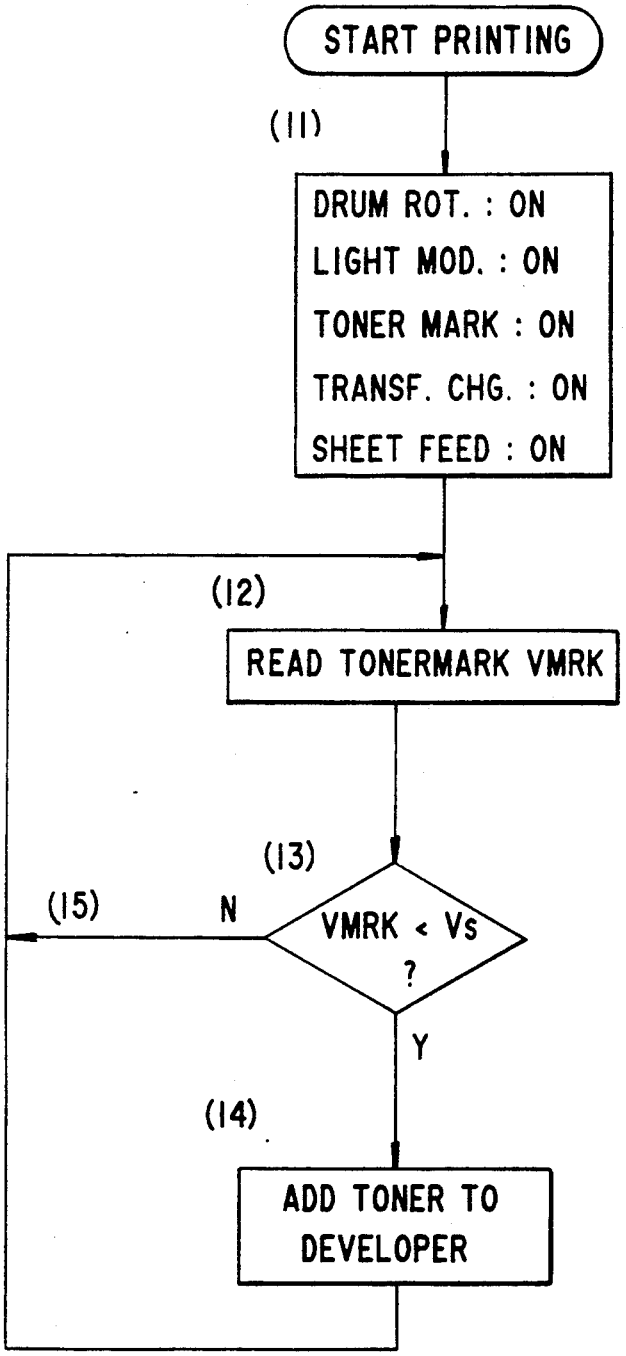
Figure 5:
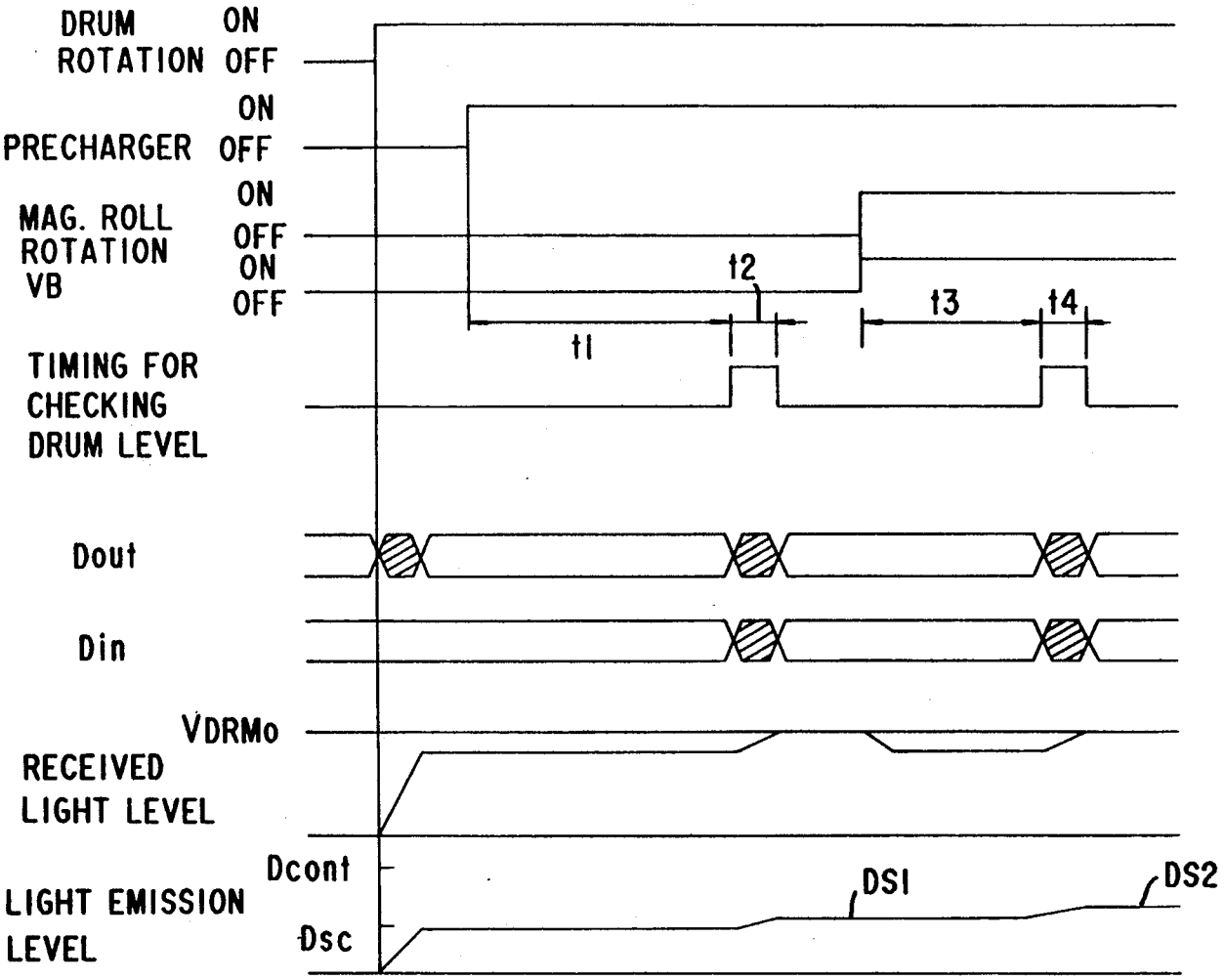
FIG. 5 is a timing chart of the steps of an embodiment of the present invention shown in FIG. 4(A).

Printing processes are independently shown in FIG. 4(B).

Figure 2:
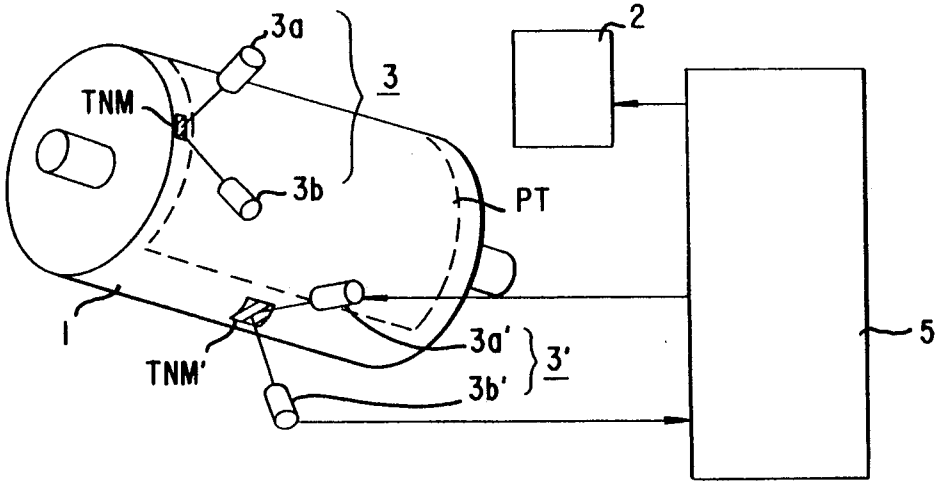
FIG. 2 schematically illustrates an optical detector and a toner mark used for the present invention.

(11) For starting the printing process, MPU 55 enables the drum rotation; the light modulator 11; the scanning device which is not shown in the figure; a toner mark generator 10 in the control circuit 5; a transfer charger 7; and feeding the sheet PP. The toner mark generator 10 outputs to the light modulator 11 a signal which produces a toner mark TNM as small as typically 5 mm square, outside a print area PT on the photosensitive drum 1, as shown in FIG. 2. When either a continuous or cut sheet is used to be printed thereon, the toner mark TNM is located aside the print area PT denoted with dotted lines and is detected by LED 3*a* and photo diode 3*b*, each connected to the control circuit 5 but the connection line is not shown in the figure When only a cut sheet is used, the toner mark TNM' may be located between the end and the start of print area PT and is detected by LED 3*a'* and photo diode 3*b'*, each connected to the control circuit 5. (An alignment procedure of the optical detector to the toner mark TNM or TNM' will be described later in detail.)

(12) The received light signal drops when the detector detects the toner mark TNM, as shown in FIG. 6(A), depending on the degree of the density of the toner in the toner mark TNM because the dark toner reduces the light reflection therefrom. A detection circuit 33 provided in the detector control circuit 3*c* (shown in FIG. 8) detects the above-described drop, i.e. a change, in the received light as shown in FIG. 6(A) and outputs a toner mark level (i.e. an amplitude) $V_{MRK}$, which is then input to MPU 55. (Dotted line in FIG. 6(A) shows a received light signal and a toner mark level $V_{MRK}'$ for the case where the optical detector 3 is contaminated.)

(13) MPU 5 checks whether the toner mark level $V_{MRK}$ is smaller than a predetermined limit level Vs, for example, 5 V in this case. If $V_{MRK} < Vs$, MPU 55 stores this information, and repeats this check for a predetermined number of cycles, for example, for printing a hundred sheets. MPU 55 checks how many times $V_{MRK} < Vs$ among the stored hundred data. When this number is over a predetermined number, such as fifty one, it is determined that the toner level is low.

(14) Then, MPU 55 instructs the toner supplier 2*b* to add toner into the developer in the developing unit 2. This step is repeated until $V_{MRK}$ on average becomes over Vs.

(15) If, $V_{MRK}$ is equal to or larger than Vs, it is judged determined that the toner is adequate. Accordingly, the printing operation is continued without adding toner into the developer.

According to the above-described preferred embodiment of the present invention, the current to drive the LED can be increased up to its possible upper limit until the detector cleaning is required, compared to a conventional method, where the limit Vs of the toner mark level must be decreased according to the decrease of the received light level. Therefore, the interval between the detector cleanings can be extended, resulting in a reduction of maintenance. Furthermore, accordingly, the reliable received light level has no effect on the detector contamination, without requiring air to be blown or requiring an additional detector, allows the printed image to keep its constant toner darkness for a longer period as well as for different drums.

The above-described method of keeping the receiving light level constant is advantageous, over the conventional analog feedback method, in that the light emission control circuit can be constituted so that the light emission control is not affected by the toner image even when the light emission control is carried out while the printing operation is performed.

Though in the above-described preferred embodiment steps 2 through 7 for keeping the receiving light level is carried out at the time of starting up the system, this automatic received-light level control may be carried out further at a predetermined period, such as an operation time of the system, an operation time of the drum rotation or a number of printed sheets after a printing operation is initiated.

Figure 8:
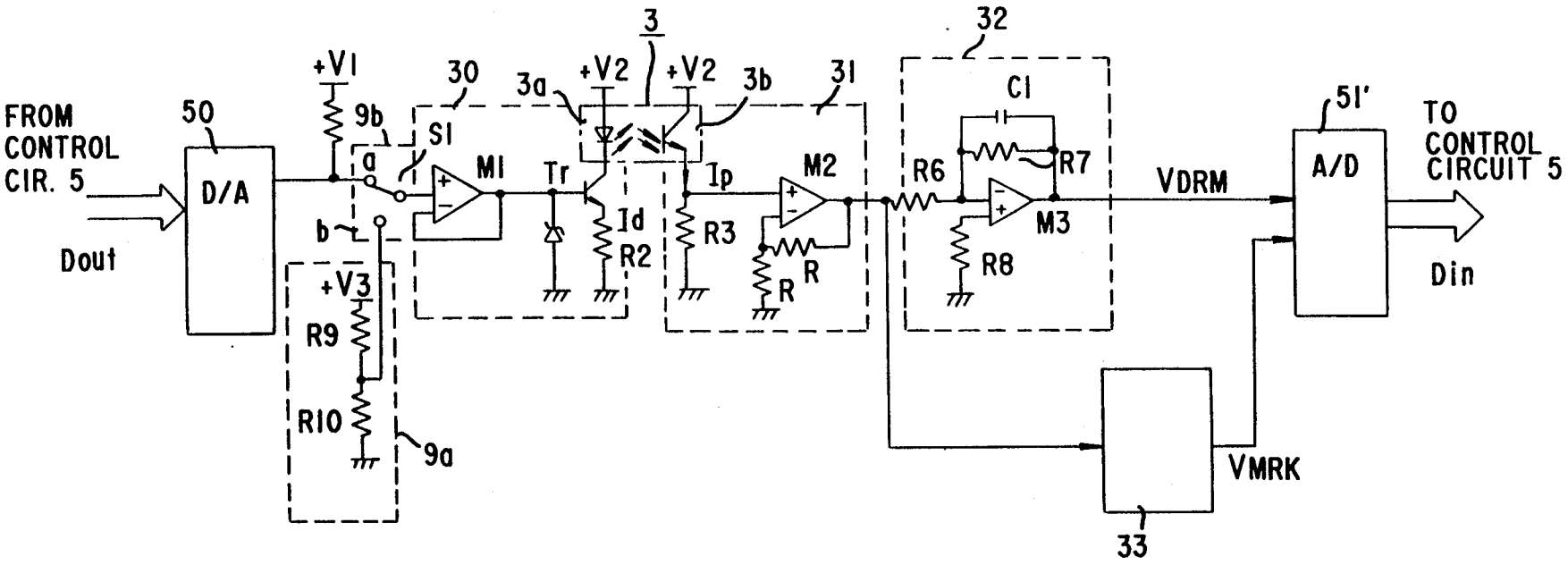
FIG. 8 is a circuit diagram of a detector control circuit of an embodiment of the present invention.

A preferred embodiment of a control circuit for aligning the optical detector is shown in FIG. 8, where the same parts are denoted with same numeral as those of previous figures. An analog output from the D/A converter 30 is input via a switch 9*b* to the voltage-current converting circuit 20, which comprises an amplifier Ml to amplify the signal input from the switch 9*b*, a transistor Tr to supply a current Id to the LED 2*a*, and a resistor R2. The current-voltage converter circuit 31 comprises a resistor R3 which generates a voltage depending on the detected current Ip of the photo transistor 2*b*, and an amplifier M2. When the detector control circuit of FIG. 8 is used for the above-described steps (1) through (10) and/or in (11) through (15), the switch 9*b* is connected to "a" position so that a feedback loop for keeping a constant receiving light level is enabled. The numeral 32 denotes an integration circuit, which is composed of a capacitor Cl, a resistor R7, an amplifier M3, and input resistors R6 and R8. The integration circuit 32 has a time constant long enough to integrate, i.e. smooth, the voltage dip, in the output of the current-voltage converting circuit, caused from the toner mark having a pulse duration as short as, for example, 5 to 20 ms, so that its output, the drum surface level $V_{DRM}$, can be handled as a substantially DC (direct current) voltage. The numeral 33 denotes a detection circuit, which comprises a diode, capacitor and a resistor (each not shown in the figure), detects an amplitude of an instantaneous voltage change in the output of the current-voltage converting circuit 31, so as to outputs a DC voltage indicating the detected amplitude. The numeral 51' is an A/D converter similar to that of the numeral 51 but further receives the toner mark level $V_{MRK}$.

When a new apparatus is assembled in a factory, or the optical detector 3 is exchanged for servicing in field, location of the optical detector must be adjusted so as to align the toner mark, along the axial direction of the photosensitive drum 1. For this alignment, the toner mark may be modified to a strip fully circulating around the photosensitive drum 1, and the photosensitive drum is generally stopped to rotate for a safety precaution. During this adjustment, the received light level is observed with an oscilloscope or a voltage meter (each not shown in the figure) connected to the output terminal of the current-voltage converting circuit 31. If the optical detector detects a portion deviated from the toner mark TNM, as shown with dotted line in FIG. 7, amplitude of the toner mark level decreases as shown by $V_{MRK}''$ in FIG. 6(B). At this time, if the feed back loop to determine the light emission level is enabled by connecting the "a" position in the switch 9*b*, the light emission level varies so as to oppose the received light level, resulting in a difficulty of finding a right position for the detector to be set. Therefore, the switch 9*b* is provided to be able select the "b" position, through which a predetermined DC voltage level is input from a level generator 9*a* to the voltage-current converting circuit 30, so that the light emission level of the LED is set constant released from the feedback operation. Thus, the constant light emission level allows an easy and correct alignment of the optical detector 3 to the toner mark TNM by simply searching for a maximum amplitude of the toner mark level $V_{MRK}$.

Though in the above-described preferred embodiments a switch 9b and the level supplier 9a are provided in the detector control circuit in order to disable the feedback loop and to provide a constant light emission level, it is apparent that these functions may be performed by firmware provided in MPU 55 instead of the switch 9b and the level supplier 9a (i.e. firmware is a hardware circuit controlled by software provided especially for the circuit).

Though in the above-described preferred embodiments a single set of the optical detector 3 or 3' is referred to, a plurality of optical detectors may be employed to detect the first and second light emission levels.

Though in the above-described preferred embodiments a laser printer employing a scanned laser light are referred to, it is apparent that the present invention may be embodied in other electrostatic printing or copying apparatus employing an LED array or liquid crystal shutter.

Though in the above-described preferred embodiments a photosensitive drum is referred to, it is apparent that the latent image forming medium is not limited to the drum-shape medium.

The many features and advantages of the invention are apparent from the detailed specification and thus, it is intended by the appended claims to cover all such features and advantages of the method which fall within the true spirit and scope of the invention. Further, since numerous modifications and changes may readily occur to those skilled in the art, it is not desired to limit the invention to the exact construction and operation shown and described, and accordingly, all suitable modifications and equivalents may be resorted to, falling within the scope of the invention.

What is claimed is:

1. A method, of controlling a recording apparatus including an image forming medium for electrostatically forming a latent image thereon according to image information to be recorded, developing means for developing said latent image as a toner image on said image forming medium, cleaning means for removing residual toner from said image forming medium after developing said toner image, a detector, including a light emitting means for projecting a light spot onto a predetermined area on said image forming medium and a light receiving means for receiving light reflected from said light spot, toner mark generating means for outputting a toner mark to said image information, said toner mark produced outside a print area on a predetermined area on said image forming medium, said toner mark detected by said detector, and a control circuit including a feedback loop for controlling a light emission level of said light emitting means so as to keep a level of the light received by said light receiving means at a predetermined level, said method comprising the steps of:

(1) forming said toner mark on said image forming medium; and (2) adjusting a location of said detector by observing said toner mark in the received light while said feedback loop is disabled and said light emission level is kept constant, wherein said adjusting operation is carried out correctly.

2. A recording apparatus comprising:

an image forming medium for electrostatically forming a latent image thereon according to image information to be recorded;

developing means for developing said latent image as a toner image on said image forming medium;

cleaning means for removing residual toner from said image forming medium after developing said toner image;

detector means, including a light emitting means for projecting a light spot onto a predetermined area on said image forming medium, and a light receiving means for receiving a light reflected from said light spot;

toner mark generating means for outputting a toner mark to said image information, said toner mark being produced outside a print area on a predetermined area on said image forming medium, said toner mark detected by said detector means; and a control circuit for controlling a light emission level of said light emitting means so as to keep a level of light received by said light receiving means at a predetermined level, said control circuit including switch means by which an input to said light emitting means is selected to one of: a feedback from said received light level and a constant voltage.

3. A recording apparatus according to claim 2, wherein said switch means is composed of a mechanical switch and said constant voltage is supplied from a direct current power source.

4. A recording apparatus according to claim 2, wherein said switch means and said constant voltage are implemented by firmware in a micro processor.

5. A method of controlling a recording apparatus that includes an image forming medium for electrostatically forming a latent image, input means for producing image information for the image forming medium, developing means for developing the latent image as a toner image on the image forming medium, cleaning means for removing residual toner from the image forming medium, a detector having light emitting means that projects a predetermined light spot on the image forming medium and light receiving means that receives light reflected from said light spot, a control circuit for controlling a light emission level of the light emitting means and for measuring a level of light received by the light receiving means, and determining means for determining at least one of deterioration of the image forming medium and a level of toner in the recording apparatus, the method comprising the steps of:

(a) disabling the input means to the image forming medium and the developing means;

(b) enabling the image forming medium and the cleaning means;

(c) designating a predetermined light level;

(d) measuring a first light emission level;

(e) enabling the developing means;

(f) adjusting the light emission level so that said received light level is substantially equal to the first light emission level;

(g) measuring a second light emission level;

(h) comparing whether a difference between the first light emission level and the second light emission level is larger than the predetermined limit level;

(i) determining the deterioration of the image forming medium and the level of toner; and (j) initiating recording by the recording apparatus.

6. A method of controlling a recording apparatus according to claim 5, further comprising the steps of: designating a predetermined light emission level; comparing whether the first light emission level is larger than the predetermined light emission level; and determining whether the detector is contaminated.

7. A method of controlling a recording apparatus according to claim 6, further comprising the step of:

outputting a signal to clean the detector when the first light emission level is larger than the predetermined light emission level.

8. A method of controlling a recording apparatus according to claim 5, further comprising the steps of:

designating a predetermined reference level;

comparing a light level of a light spot projected by the light emitting means of the detector with the predetermined reference level;

determining whether the light spot light level is smaller than the predetermined reference level; and adjusting the light spot light level to be equal to the predetermined reference level.

9. A method of controlling a recording apparatus according to claim 8, wherein said comparing, determining and adjusting steps with the light spot light level and predetermined reference level occur prior to enabling the developing means.

10. A method of controlling a recording apparatus according to claim 8, wherein said comparing, determining and adjusting steps with the light spot light level and predetermined reference level occur prior to enabling the image forming medium and operation of the enabled developing means.

11. A method of controlling a recording apparatus according to claim 8, wherein said comparing, determining and adjusting steps with the light spot light level and predetermined reference level occur during operation of the enabled image forming medium.

12. A method of controlling a recording apparatus, according to claim 5, wherein disabling said developing means includes disabling rotation of a magnetic roll and application of a bias voltage thereto, and enabling said developing means includes enabling rotation of a magnetic roll and application of a bias voltage thereto.

13. A method of controlling a recording apparatus, according to claim 5, further comprising the step of:

detecting deterioration of said image-forming medium and said developing means.

14. A method of controlling a recording apparatus that includes an image forming medium for electrostatically forming a latent image, input means for producing image information for the image forming medium, developing means for developing the latent image as a toner image on the image forming medium, cleaning means for removing residual toner from the image forming medium, a detector having light emitting means that projects a predetermined light spot on the image forming medium and light receiving means that receives light reflected from said light spot, a control circuit for controlling a light emission level of the light emitting means and for measuring a level of light received by the light receiving means, and determining means for determining contamination of the detector, the method comprising the steps of:

(a) disabling the input means to the image forming medium and the developing means;

(b) enabling the image forming medium and the cleaning means;

(c) designating a predetermined light emission level;

(d) measuring a first light emission level and maintaining the received first light emission level at said predetermined light emission level;

(e) enabling the developing means;

(f) comparing whether the first light emission level is larger than the predetermined light emission level;

(g) determining the contamination of the detector; and (h) initiating recording by the recording apparatus.

15. A method of controlling a recording apparatus according to claim 14, further comprising the step of:

outputting a signal to clean the detector when the first light emission level is larger than the predetermined light emission level.

16. A method of controlling a recording apparatus that includes an image forming medium for electrostatically forming a latent image, input means for producing image information for the image forming medium, developing means for developing the latent image as a toner image on the image forming medium, cleaning means for removing residual toner from the image forming medium, a detector having light emitting means that projects a predetermined light spot on the image forming medium and light receiving means that receives light reflected from said light spot, toner mark generating means for generating a toner mark on a predetermined area on the image forming medium, a control circuit for controlling a light emission level of the light emitting means and for measuring a level of light received by the light receiving means, and determining means for determining of at least one of deterioration of the image forming medium and a level of toner in the recording apparatus, the method comprising the steps of:

(a) disabling the input means to the image forming medium and the developing means;

(b) enabling the image forming medium and the cleaning means;

(c) designating a predetermined light level;

(d) detecting the toner mark with the detector;

(e) adjusting the location of the detector based on the toner mark;

(f) measuring a first light emission level;

(g) enabling the developing means;

(h) measuring a second light emission level;

(i) comparing whether a difference between the predetermined first light emission level and the second light emission level is larger than the predetermined limit level;

(j) determining the deterioration of the image forming medium and the level of toner; and (k) initiating recording by the recording apparatus.

17. A method of controlling a light emitter to maintain a constant output from a light detector, the method comprises the steps of:

rotating a photosensitive drum;

enabling a pre-charger;

cleaning a photosensitive drum surface by rotation thereof;

measuring a first light reflection level from the photosensitive drum surface;

comparing the measured first light reflection level with a predetermined first reference level, as an indication of light detector deterioration;

enabling a magnetic roller rotation, enabling a bias voltage application to the magnetic roller and enaling a toner mixer rotation if the light reflection level is equal to the first reference level;

measuring a second light reflection from the photosensitive drum surface;

comparing a measured second light reflection with a predetermined second reference level;

obtaining a difference of the first and second reflection levels if the second light reflection level is equal to the second reference level; and adding toner to a developer until the difference reaches a third reference level if the difference between said first and second reflective levels is greater than a predetermined third level.

18. A method of controlling a light emitter according to claim 17, further comprising the step of:

measuring the reflections from the photosensitive drum by measuring the light emission level.

* * * * *